US005775243A

United States Patent [19]

Kinoshita et al.

[11] Patent Number: 5,775,243

[45] Date of Patent: Jul. 7, 1998

[54] THREAD EXCHANGER DEVICE FOR SEWING MACHINE

[76] Inventors: Haruhiko Kinoshita, 201, Marusin, Kita-ku, Nagoya; Sei Kato, 502, Takabari 5-chome, Meito-ku, Nagoya, both of Japan

[21] Appl. No.: 710,518

[22] Filed: Sep. 18, 1996

[51] Int. Cl.[6] ..... D05B 59/04

[52] U.S. Cl. ..... 112/186

[58] Field of Search ..... 112/186, 279, 112/180, 196, 228, 302; 242/20, 23

[56] References Cited

U.S. PATENT DOCUMENTS

| | | | |
|---|---|---|---|
| 3,744,442 | 7/1973 | Michaels et al. | 112/186 |
| 4,186,677 | 2/1980 | Sacchetti | 112/186 |
| 5,143,004 | 9/1992 | Mardix et al. | 112/186 |
| 5,584,257 | 12/1996 | Nakamura et al. | 112/279 |

OTHER PUBLICATIONS

Patent Abstracts of Japan, vol. 96, No. 008 & JP 08 196766 A (Kinoshita Seimitsu Kogyo KK; Kato Tadashi), Aug. 6, 1996, *Abstract.

Patent Abstracts of Japan, vol. 95, No. 010 & JP 07 275552 A (Tadashi Kato; Others: 01), Oct. 24, 1995, *Abstract.

*Primary Examiner*—Ismael Izaguirre

*Attorney, Agent, or Firm*—Sughrue, Mion, Zinn, Macpeak & Seas, PLLC

[57] ABSTRACT

In a thread exchanger device for a sewing machine, a rotary cassette has a plurality of bobbin casings along a circumferential direction thereof. A cassette driver is provided to rotationally drive the rotary cassette to select one of the plurality of bobbin casings so as to move it to an exahangeable position. A chuck is provided to take the bobbin casing off the rotary cassette on the one hand, and attaching to the rotary cassette on the other hand. A chuck driver is provided to alternately move the chuck toward a rotary bobbin frame, and move it toward the exchangeable position.

2 Claims, 5 Drawing Sheets

THREAD EXCHANGER DEVICE FOR SEWING MACHINE

BACKGROUND OF THE INVENTION

Field of the Invention

This invention relates to a thread exchanger device for a sewing machine which is capable of automatically changing a bobbin on which a sewing thread is wound.

DESCRIPTION OF THE PRIOR ART

Upon sewing apparel, the sewing threads are freely selected depending on apparel products while taking their color, material, texture and cost into consideration. When changing the sewing threads, the following procedures have usually been required.

(i) Taking a bobbin casing out of a rotary bobbin frame, (ii) Taking a bobbin out of the bobbin casing, (iii) Selecting a specified bobbin having the desired thread exchangeable from various types of sewing threads, (iv) Attaching the specified bobbin to the bobbin casing, (v) Returning the exchanged bobbin casing to the rotary bobbin frame.

The same is substantially true when exchanging the bobbin due to the shortage of the sewing thread used.

However, these procedures make the operation troublesome and time-consuming to render the work inefficient at the time of changing the threads and exchanging the bobbin due to the shortage of the sewing thread.

For this reason, it has been desired to introduce a sewing thread exchanger device which is capable of automatically exchanging the sewing threads and bobbins.

Therefore, it is one of the objects of the invention to provide a sewing thread exchanger device which is capable of automatically changing the sewing threads and bobbins.

SUMMARY OF THE INVENTION

According to the present invention, there is provided a thread exchanger device for a sewing machine comprising: a rotary cassette having a plurality of bobbin casings along a circumferential direction thereof; a cassette drive member provided to rotationally drive the rotary cassette to select one of the plurality of bobbin casings so as to move it to an exchangeable position; a chuck member provided to take the bobbin casing off the rotary cassette on the one hand, and attaching to the rotary cassette on the other hand; and a chuck drive member provided to alternately move the chuck member toward a rotary bobbin frame, and moving it toward the exchangeable position.

According to another aspect of the present invention, the chuck drive member comprises: a support plate having a first cam groove provided along a central axis of the rotary bobbin frame, a second cam groove defined toward the exchangeable position, and a third cam groove connecting one end of the first cam groove and one end of the second cam groove each opposite to the rotary bobbin frame and the exchangeable position in which the bobbin casing occupies; an oscillating neck member pivotably provided around an axis mounted on the support plate, and the oscillating neck member having a cam stud moving along the first, second and third cam groove so as to bring the chuck member; and a drive member provided to reciprocally move the chuck along the first, second and third cam groove.

According to other aspect of the present invention, the rotary cassette forms a disc-shaped configuration which has the plurality of the bobbin casings at regular intervals; and the cassette drive member comprising: a rotary disc rotatably supporting the rotary cassette, and having a plurality of index pins at regular intervals; a press member actuated by an armature rod protracted to push one of the index pins so as to rotationally move the rotary cassette through the rotary disc; and an index claw which clutches the index pin to prohibit its movement when actuating the rod to retract.

Upon replacing a bobbin within a bobbin casing by another bobbin when a bobbin casing is not placed in a cassette exchangeable position, the chuck drive member drives the chuck member toward the rotary bobbin frame so as to clutch the bobbin casing within the rotary bobbin frame. Then, the chuck drive member moves the chuck member toward the cassette exchangeable position so as to bring the bobbin casing to an empty address of the rotary cassette at the exchangeable position. After attaching the bobbin casing to the empty address of the rotary cassette, the chuck member moves away from the cassette exchangeable position.

With an actuation of the cassette drive member, the cassette is driven to move the bobbin casing accommodating the bobbin toward the cassette exchangeable position so as to attach the bobbin casing to the rotary bobbin frame. Then, the chuck drive member moves the chuck member toward the bobbin casing so that the chuck member clutches the bobbin casing. The chuck drive member further moves the chuck member toward the rotary bobbin frame to accommodate the bobbin case into the rotary bobbin frame. After accommodating the bobbin casing into the rotary bobbin frame, the chuck member moves away from the rotary bobbin frame. Thus, the sewing threads and bobbins are automatically exchanged.

With an actuation of the drive member, it is possible to reciprocally move the chuck member along the first, second and third cam groove. Meanwhile, since the oscillating neck member swingingly moves about the axis provided on the support plate, it is possible to move the chuck member toward the rotary bobbin frame in combination with the cam stud moving along the first cam groove (first action), and moving the chuck member toward the cassette exchangeable position in association with the cam stud moving along the second cam groove (second action), and further pivotally moving the chuck member about the axis in association with the cam stud moving along the third cam groove.

With a single stud drive member, it is possible to enable the first and second action. This makes the thread exchanger device compact as a whole, and thereby making it possible to accommodate the thread exchanger device into a limited space under a sewing table of a sewing machine.

In the sense that the stud drive member has only a single actuator to enable the first and second action, it contributes to cost-saving compared with the case in which it requires two actuators to individually enable the first and second action.

With a protraction of the actuator rod, the press member pushes the specified index pin to rotationally move the cassette and the disc member by a predetermined angle. With a retraction of the actuator rod, the index claw engages against the index pin to prohibit its movement. That is, it is possible to rotationally move the cassette and the disc member by the predetermined angle with a single movement of the actuator rod.

Then, it is possible to angularly move the cassette so as to change the bobbin casing located at the exchangeable position by appropriately controlling times and timing of the actuator rod.

BRIEF DESCRIPTION OF THE DRAWINGS

The preferred embodiments of the invention will be described in more detail with reference to the following drawing figures, of which.

DETAILED DESCRIPTION OF THE PREFERRED EMBODIMENTS

Figure 1:
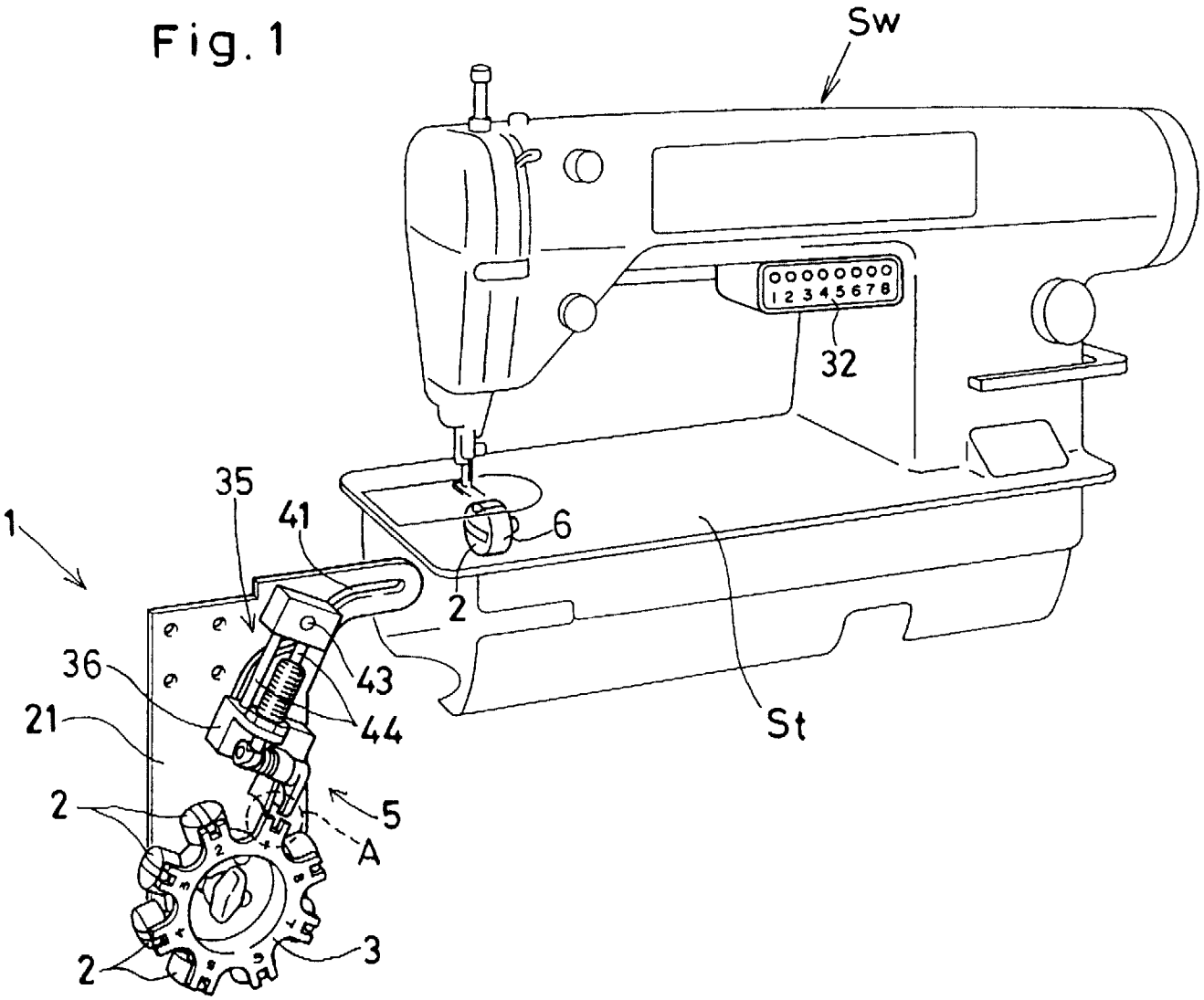
FIG. 1 is a perspective view of a sewing machine depicted with its peripheral component parts.

Referring first to FIG. 1 which shows a sewing machine (Sw) into which a thread exchanger device 1 is incorporated, the thread exchanger device 1 has a disc-shaped cassette 3, around periphery of which a plurality of e.g., eight bobbin casings 2 are circumferentially provided at regular intervals. In the thread exchanger device 1, a cassette drive member 4 is provided to rotationally move the cassette 3 so as to bring a specified bobbin casing 2 toward an exchangeable position (A). A chuck 5 is provided to take the bobbin casing 2 off the cassette 3 and to attach it to the cassette 3. A chuck drive member 7 is provided to move the chuck 5 toward a rotary bobbin frame 6, and move the chuck 5 toward the exchangeable position (A).

Figure 4:
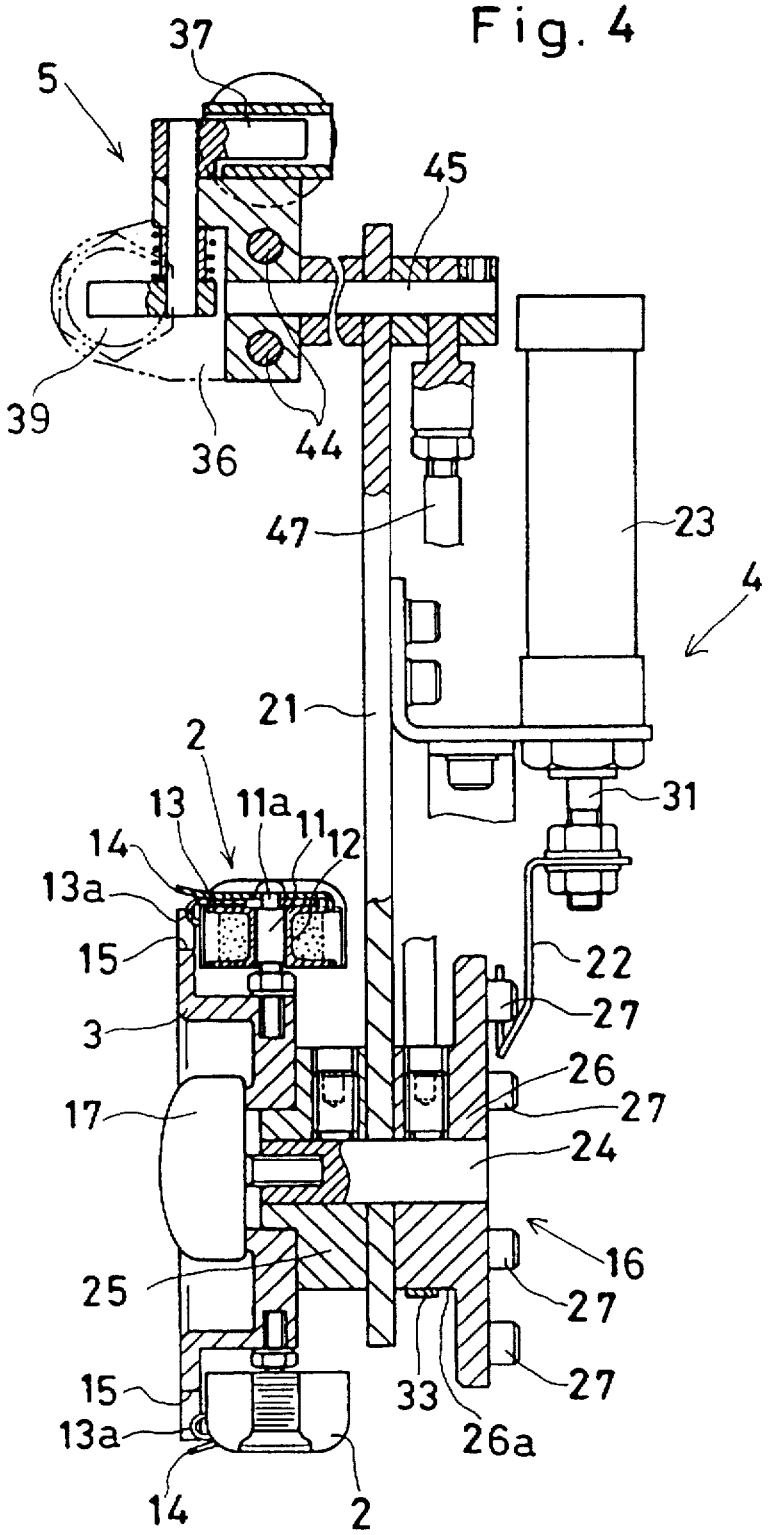
FIG. 4 is a longitudinal cross sectional view of the thread exchanger device according to the embodiment of the invention.

Around the periphery of the cassette 3, eight bobbin pins 11 are provided at regular intervals particularly as shown in FIG. 4. To each of the bobbin pins 11, the bobbin casing 2 is attached which accommodates a bobbin 12 on which a sewing thread is wound. An upper portion of the bobbin pin 12 is partially notched to provide a diameter-reduced portion 11*a* to which a bobbin clamp 13 is detachably hooked by way of its aperture 13*b*. The bobbin clamp 13 has a lock lever 14 to pivotably move the clamp 13 so as to engage and disengage from the diameter-reduced portion 11*a* of the bobbin pin 12. By engaging the aperture 13*b* of the clamp 13 against the diameter-reduced portion 11*a*, the bobbin casing 2 is locked on the bobbin pin 11.

Figure 2:
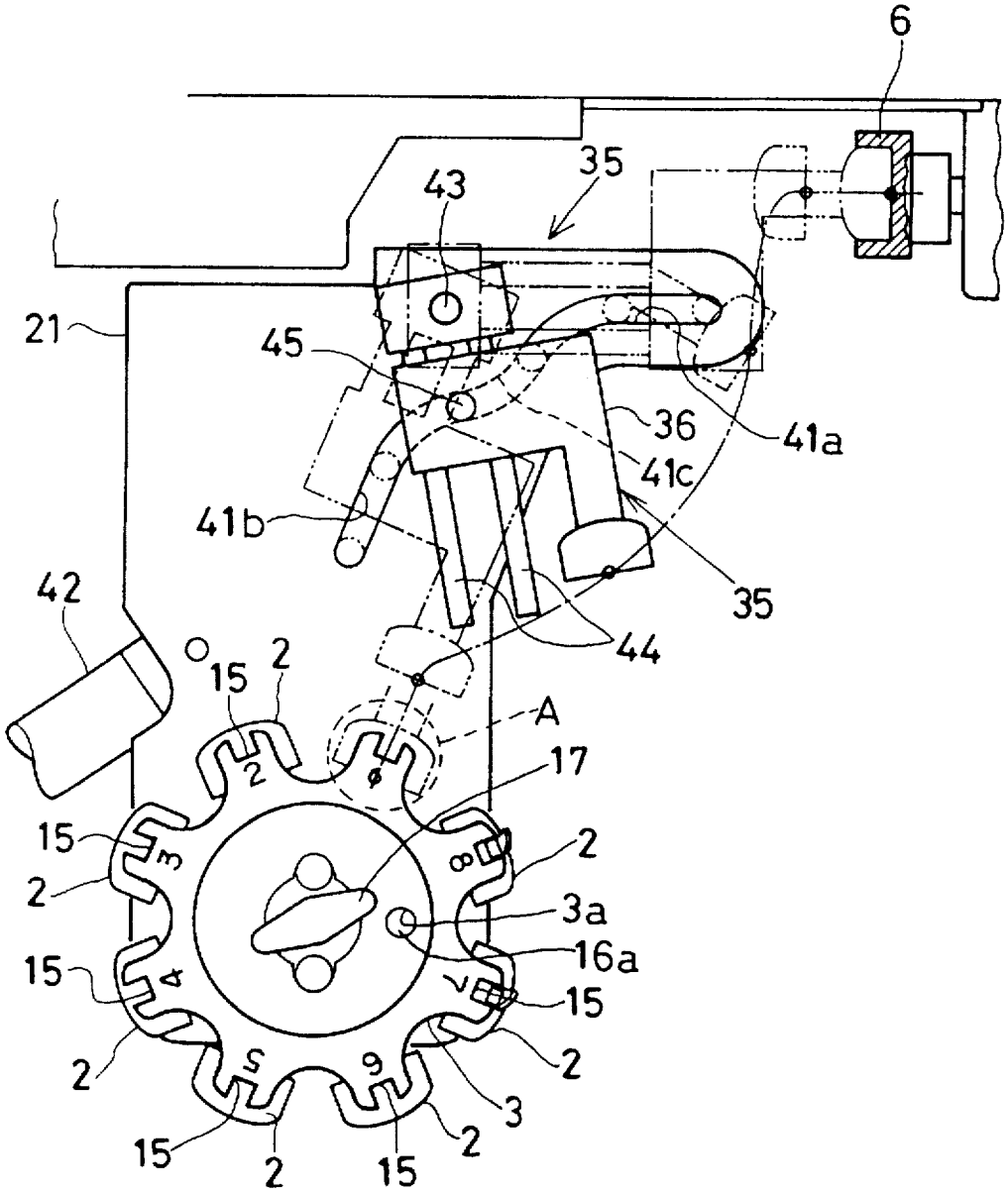
FIG. 2 is a plan view of a thread exchanger device according to an embodiment of the invention.

On a side of an operator sitting behind the sewing machine, the cassette 3 has a notched portion 15 in correspondence to the bobbin pin 11 as shown in FIGS. 2 and 4. The notched portion 15 regulates the movement of a prong 13*a* extending outward from the bobbin clamp 13, and thereby outwardly directing a lever of the lock lever 14 of the bobbin casing 2 which is to be attached to the cassette 3.

It is to be observed that the lever tab of the lock lever 14 may be directed backward or downward instead of outward.

Figure 3:
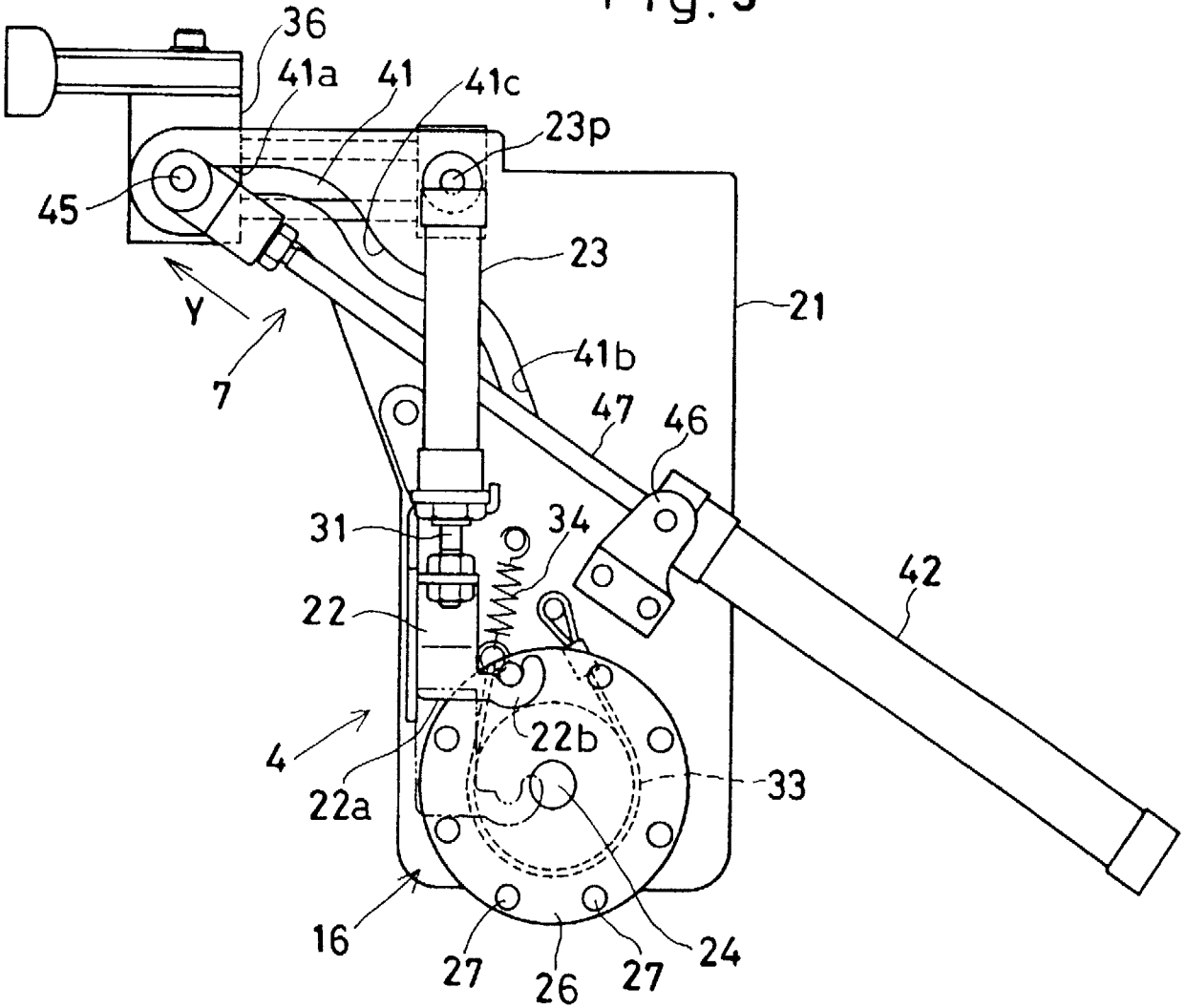
FIG. 3 is a rear view of the thread exchanger device according to the embodiment of the invention.

The cassette 3 is placed on a rotary disc 16 to rotationally move in combination with the disc 16 as described in detail hereinafter. As shown in FIGS. 2 and 3, the cassette 3 has a lock hole 3*a* into which a stud pin 16*a* is interfit which is mounted on the rotary disc 16. With the stud pin 16*a* placed in the lock hole 3*a*, the cassette 3 is fixed to the rotary disc 16 by means of a lock knob 17. This makes it possible for the cassette drive member 4 to recognize the number (first to eighth) affixed to a place to which the bobbin casing 2 is attached.

The cassette drive member 4 is installed under a sewing table (St) of the sewing machine (Sw) to be accommodated into a limited space which is in registration with the rotary bobbin frame 6. As shown in FIGS. 3 and 4, the cassette drive member 4 has a support plate 21 whose front and back surface are oriented toward the operator sitting behind the sewing machine (Sw). The support plate 21 rotationally supports the rotary disc 16 around its central portion. The support plate 21 also supports an index pawl 22 so that the pawl 22 can be reciprocally driven by an air cylinder 23.

The rotary disc 16 has an index shaft 24 rotatably arranged relative to the support plate 21, and at the same time, having a cassette mount disc 25 arranged outward the support plate 21 to rotate in combination with the index shaft 24. An index disc 26 is provided behind the support plate 21 to rotate in combination with the index shaft 24.

On a reverse surface of the index disc 26, eight index pins 27 are provided circumferentially in correspondence to the bobbin pins 11. Each of the index pins 27 is formed into columnar configuration, and placed circumferentially around the periphery of the index disc 26 at regular intervals.

The index pawl 22 is shaped into L-shaped and configuration as shown in FIG. 3 when looked behind the support plate 21. A lower end of the index pawl 22 has a press member 22*a* which pushes one of the index pins 27 downward so as to angularly rotate it by 45 degrees when the air cylinder 23 downwardly protracts an actuator rod 31. The index pawl 22 has a regulation claw 22*b* laterally extending to engage with the index pin 27. When the air cylinder 23 retracts the actuator rod upward, the regulation claw 22*b* engages with the index pin 27 two blocks next to the one which the press member 22*a* had pushed. This regulates the movement of the index pin 27 to prohibit the rotational movement of the rotary disc 16 and the cassette 3.

As shown precisely in FIG. 3, the air cylinder 23 is installed on the reverse side of the support plate 21, and adapted to protract and retract the actuator rod (armature) 31 depending on an air pressure supplied thereto. The air cylinder 23 is pivotably supported at a pin 23*p* on the support plate 21 so that the actuator rod 31 protracts downward and retracts upward depending on the air pressure supplied by an air compressor (not shown).

With an operation of a control panel 32, the panel 32 selects the number affixed to the bobbin casing 2, and the air cylinder 23 is controlled such as to locate the selected bobbin casing 2 at the exchangeable position (A) after attaching the bobbin casing 2 to an empty address of the cassette 3 at the time of changing the sewing threads.

In the cassette drive member 4, a brake member is provided to regulate the loose movement of the rotary disc 16. The brake member has a brake shoe 26*a* provided on a diameter-reduced portion of the index disc 26. Around the brake shoe 26*a*, a brake band 33 encircles it, which is always urged by a coil spring 34 in such a direction as to engage the brake band 33 against the brake shoe 26*a*. The brake member, thus structured, prevents the rotary disc 16 from being inadvertently rotated when protracting the actuator rod 31 at the time of releasing the engagement of the index pin 27 from the regulation claw 22*b*.

Figure 5:
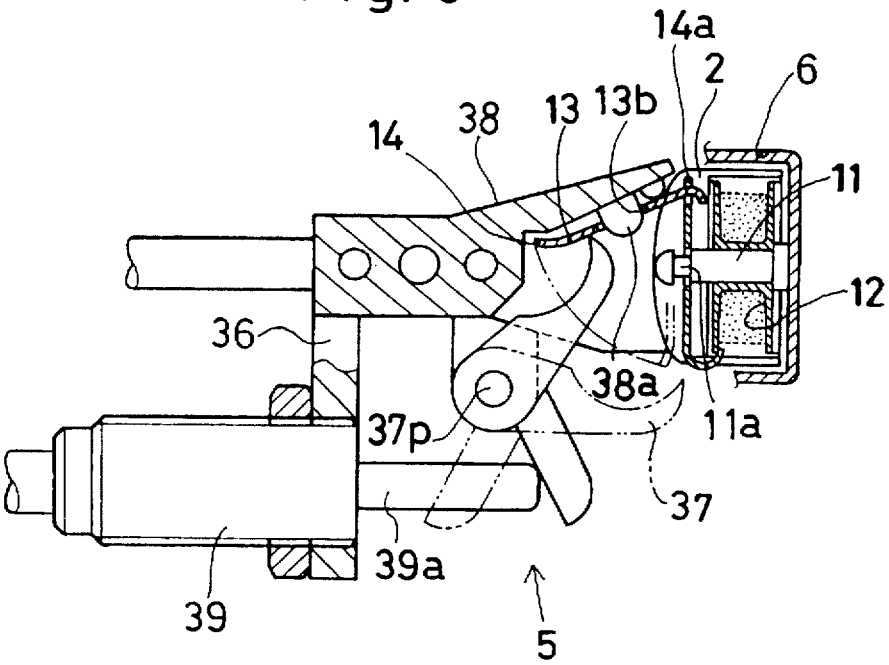
FIG. 5 is an enlarged cross sectional view of a chuck member.

As shown in FIG. 5, a chuck structure is provided on a slider casing 36 of an oscillating neck member 35 which is described in detail hereinafter. In the chuck structure, a hook pawl 37 is pivotably provided at 37*p* to snap open the lock lever 14 of the bobbin casing 2. A clutch hand 38 is provided which has a finger 38*a* which is admitted by the aperture 13*b* of the lock lever 14 pried open by the hook pawl 37. With the finger 38*a* admitted by the aperture 13*b* and the hook pawl 37 engaging the bobbin clamp 13 against the clutch hand 38, the chuck 5 clutches the bobbin casing 2 in which the bobbin clamp 13 is released from the engagement against the bobbin pin 11 of the rotary bobbin frame 6.

The hool pawl 37 is actuated by an a rod 39*a* of an air cylinder 39 to move upward, and actuated downward to return the original position with an assist of a return spring (not shown). The hook pawl 37 hooks the lock lever 14 to raise it by the air cylinder 39 when the chuck 5 takes the bobbin casing 2 out of the rotary bobbin frame 6. The hook pawl 37 returns to the original position with the assist of a return spring when the bobbin casing 2 is attached to the cassette 3 at the exchangeable position (A). When the chuck 5 holds the bobbin casing 2 after taking it out of the cassette 3, the air cylinder 39 raises the lock lever 14 to rotate it open about a fulcrum 14*a*, and returning it to the original position due to the urging force of the return spring when the bobbin casing 2 is accommodated into the rotary bobbin frame 6.

With the use of a controller panel, the air cylinder 39 is controlled by switching a pneumatic supply and cessation takes place at the time of actuating the hook pawl 37.

The chuck drive member 7 has a cam groove 41 provided on the support plate 21, and having the oscillating neck member 35 provided on an outer surface of the support plate 21 as shown in FIGS. 2 and 3. On a reverse side of the support plate 21, an air cylinder 42 is provided as a driving source of the chuck drive member 7.

The cam groove 41 of the support plate 21 has a first cam groove 41*a* directed to the rotary bobbin frame 6, a second cam groove 41*b* oriented to the specified bobbin casing 2 to be exchanged, and further having a third cam groove 41*c* connecting one end of the first cam groove 41*a* and one end of the second cam groove 41*b* each located opposite to the rotary bobbin frame 6 and the specified bobbin casing 2. On the reverse side of the support plate 21, a regulation axis 43 is provided at an intersection in which two extension lines of the first cam groove 41*a* meets the second cam groove 41*b*. The regulation axis 43 serves as a pivotal center of the oscillating neck member 35.

As shown in FIG. 2, the oscillating neck member 35 has parallel slider pins 44 arranged to pivotally move about the regulation axis 43. Along the slider pins 44, the slider casing 36 is adapted to reciprocally slide. The slider casing 36 has the chuck 5 and a cam stud 45 which reciprocally slides along the cam groove 41.

As clearly shown in FIG. 3, the air cylinder 42 is supported on the reverse side of the support plate 21 by way of an anchor pin 46. With an actuation of the air cylinder 42, a protracted armature 47 moves the cam stud 45 along the first cam groove 41*a* until the stud 45 encounters a closed end of the first cam groove 41*a* in the direction of arrow Y of FIG. 3 since the cam stud 45 is pivoted on a front end of the armature 47. When the air cylinder 42 is reversely actuated, the retracted armature 47, the cam stud 45 moves along the cam groove 41 until the stud 45 encounters a closed end of the second cam groove 41*b*.

A pneumatic supply to the air cylinder 42 is carried out by means of thread changing signals so that the chuck 5 can clutch the bobbin casing 2 accommodated into the rotary bobbin frame 6. After clutching the bobbin casing 2, the air cylinder 42 is exhausted to attach the clutched bobbin casing 2 to the empty address of the cassette 3. Then, the pneumatic source is supplied again to the air cylinder 42 to move the chuck 5 away from the exchangeable position (A) while moving the selected bobbin casing 2 toward the exchangeable position (A) by means of the cassette drive member 4. Thereafter, the air cylinder 42 is exhausted so that the chuck 5 can clutch the selected bobbin casing 2 located at the exchangeable position (A). The pneumatic supply to the air cylinder 42 is carried out again to attach the selected bobbin casing 2 to the rotary bobbin frame 6, and the air cylinder 42 is exhausted to move the chuck 5 away from the rotary bobbin frame 6. The pneumatic supply and exhaust are regulated by a controller.

With the structure thus far described, the bobbin casing 2 is taken out of the first position of the cassette 3 so as to manually attach the bobbin casing 2 to the rotary bobbin frame 6, and then the cassette 3 is attached to the rotary disc 16 with the first position left empty. The cassette 3 is locked to the rotary disc 16 by means of the lock knob 17. When the thread exchanger device 1 is deenergized, the first position of the cassette 3 is adapted to return to the exchangeable position (A) by interfitting the pin 16*a* of the roraty disc 16 into the lock hole 3*a* of the cassette 3. When the bobbin casing 2 is not accommodated into the rotary bobbin frame 6, the cassette 3 may be attached to the rotary disc 16 with the eight bobbin casings carried on the cassette 3.

While energizing the thread exchanger device 1, the sewing operation is interrupted to sever the thread so as to newly change the sewing threads. With the operation of the control panel 32, the number of the bobbin casing 2 is selected in which the desired thread is wounded on the bobbin 12.

(1) Then, the air cylinder 42 protracts the armature 47 to move the chuck 5 toward the bobbin casing 2 accommodated into the rotary bobbin frame 6 (first action).

(2) In consequence, the air cylinder 39 protracts the actuator rod 39*a* so that the hook pawl 37 pulls the lock lever 14 of the bobbin casing 2 within the rotary bobbin frame 6 so as to hold the bobbin casing 2 in position.

(3) The air cylinder 42 retracts the armature 47 to move the chuck 5 toward the exchangeable position (A) (second action). Then, the bobbin of the bobbin casing 2 which the chuck 5 clutches, is attached to the bobbin pin 11 in which the bobbin casing is absent.

(4) The air cylinder 39 retracts the actuator rod 39*a* so that the hook pawl 37 returns to the original position by the action of the return spring. This reverts the lock lever 14 to the original position so as to lock it on the bobbin pin 11.

(5) Then, the air cylinder 42 protracts the armature 47 to move the chuck 5 away from the exchangeable position (A).

(6) The air cylinder 23 protracts and retracts the armature 31 to rotate the cassette 3 by way of the rotary disc 16 so as to locate the selected bobbin casing 2 at the exchangeable position (A).

(7) The air cylinder 42 retracts the armature 47 to move the chuck 5 toward the exchangeable position (A) (second action).

(8) The air cylinder 39 protracts the actuator rod 39*a* to pull up the lock lever 14 of the bobbin casing 2 to hold the bobbin casing 2 at the exchangeable position (A).

(9) The air cylinder 42 protracts the armature 47 to move the chuck 5 toward the bobbin frame 6 (first action). This attaches the bobbin of the bobbin casing 2 to the rotary bobbin frame 6.

(10) The air cylinder 39 retracts the actuator rod 39*a* to return the hook pawl 37 to the original position with the assist of the return spring. This returns the lock lever 14 of the bobbin casing 2 to the original position so as to lock the bobbin casing 2 on the rotary bobbin frame 6.

(11) The air cylinder 42 retracts the armature 47 to move the chuck away from the rotary bobbin frame 6 so as to complete the thread changing operation.

(a) As understood from the foregoing description, it is possible to automatically change the threads selected by the control panel 32 as desired. It is to be observed that it is possible to change bobbins because of the shortage of the sewing thread wound on the bobbin.

(b) The first and second action are carried out with the single air cylinder 42, and thereby making the thread exchanger device 1 compact as a whole so as to accommodate it into the limited space left under the sewing table (St) of the sewing machine (Sw).

(c) With the single armature 47 needed to carry out the first and second action in the air cylinder 42, it is advantageous from the cost-saving point of view compared to the case in which dual actuator rods is needed to execute the first and second action.

It is appreciated that instead of the rotary cassette 3, another cassette may be used in which a plurality of bobbin casings may be linearly arranged, and the cassette may slidably moves by means of a cassette drive member.

It is noted that slider pins may be slidably and rotationally provided about the regulation axis 43 on the slider casing 36 of the oscillating neck member 35 as disclosed by Japanese Patent Application No. 6-67024 instead of the chuck slider pins 44.

It is also noted that instead of the air cylinders, a servomotor may be used, or otherwise transmission power from the sewing machine may be used by way of gear trains or belts.

While the invention has been described with reference to the specific embodiments, it is understood that this description is not to be construed in a limiting sense in as much as various modifications and additions to the specific embodiments may be made by skilled artisans without departing from the scope of the invention.

What is claimed is:

1. A thread exchanger device for a sewing machine comprising:

a rotary cassette having a plurality of bobbin casings along a circumferential direction thereof;

a cassette driver member provided to rotationally drive the rotary cassette to select one of the plurality of bobbin casings so as to move it to an exchangeable position;

a chuck member provided to take the bobbin case off the rotary cassette on the one hand, and attaching to the rotary cassette on the other hand; and a chuck drive member provided to alternately move the chuck member toward a rotary bobbin frame, and move it toward the exchangeable position;

the chuck drive member further comprising:

a support plate having a first cam groove provided along a central axis of the rotary bobbin frame, a second cam groove defined toward the exchangeable position, and a third cam groove connecting one end of the first cam groove and one end of the second cam groove each opposite to the rotary bobbin frame and the exchangeable position in which the bobbin casing occupies:

an oscillating neck member pivotably provided around an axis mounted on the support plate, and the oscillating neck member having a cam stud moving along the first, second and third cam groove so as to move the chuck member; and a drive member provided to reciprocally move the chuck along the first, second and third cam groove.

2. A thread exchanger device for a sewing machine as recited in claim 1, wherein the rotary cassette forms a disc-shaped configuration which has the plurality of the bobbin casings at regular intervals;

the cassette driver member comprising:

a rotary disc rotatably supporting the rotary cassette, and having a plurality of index pins at regular intervals;

a press member actuated by an armature rod protracted to push one of the index pins so as to rotationally move the rotary cassette through the rotary disc; and an index claw which clutches the index pin to regulate its movement when actuating the rod to retract.

* * * * *